US008707594B2

(12) United States Patent
Glass et al.

(10) Patent No.: US 8,707,594 B2
(45) Date of Patent: Apr. 29, 2014

(54) CARD READER ACCESSIBLE MULTIPLE TRANSACTION CARD HOLDER

(71) Applicant: Gift Card Impressions, LLC, Kansas City, MO (US)

(72) Inventors: Brett R. Glass, Kansas City, MO (US); Nicole E. Glass, Kansas City, MO (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/745,744

(22) Filed: Jan. 18, 2013

(65) Prior Publication Data

US 2013/0192105 A1 Aug. 1, 2013

Related U.S. Application Data

(60) Provisional application No. 61/587,762, filed on Jan. 18, 2012.

(51) Int. Cl.
*G09F 1/04* (2006.01)

(52) U.S. Cl.
USPC ..... 40/124.06; 40/124.09; 40/124.11

(58) Field of Classification Search
USPC ..... 40/124.06, 124.09, 124.11; 229/92.8, 229/92.1
See application file for complete search history.

(56) References Cited

U.S. PATENT DOCUMENTS

| | | | | |
|---|---|---|---|---|
| 5,862,979 | A * | 1/1999 | Hill et al. | 229/92.1 |
| 7,861,441 | B1 * | 1/2011 | Hoellwarth | 40/124.06 |
| 2003/0150141 | A1 * | 8/2003 | Waldron | 40/124.11 |
| 2003/0150142 | A1 * | 8/2003 | Street | 40/124.11 |
| 2004/0093773 | A1 * | 5/2004 | Clark | 40/124.06 |
| 2005/0230460 | A1 * | 10/2005 | Ristau | 229/92.8 |
| 2009/0212552 | A1 * | 8/2009 | McDonough et al. | 283/67 |
| 2010/0011634 | A1 * | 1/2010 | Dweck et al. | 40/124.06 |
| 2010/0251582 | A1 * | 10/2010 | Kershner et al. | 40/124.06 |
| 2013/0067780 | A1 * | 3/2013 | Glass et al. | 40/124.06 |

* cited by examiner

*Primary Examiner* — Gary Hoge
(74) *Attorney, Agent, or Firm* — Polsinelli PC

(57) ABSTRACT

A card holder assembly for holding multiple transaction cards, such as gift cards, to a common backer panel for presentation and sale. Cards mounted on the backer panel may be lifted for scanning by a card reader without necessitating removal of the cards from the assembly.

10 Claims, 13 Drawing Sheets

CARD READER ACCESSIBLE MULTIPLE TRANSACTION CARD HOLDER

CROSS REFERENCE TO RELATED APPLICATIONS

This application claims the benefit of the prior filed, co-pending provisional application, Ser. No. 61/587,762, filed Jan. 18, 2012, incorporated by reference herein.

BACKGROUND OF THE INVENTION

This invention relates generally to transaction card holders and more particularly to a card holder for holding multiple transaction cards that allows the cards to be scanned by a card reader without detachment from the holder.

Transaction cards, stored value cards, or gift cards, as they are commonly called, based upon their intended use, have become popular gifts. Gift cards are typically provided with pre-designated amounts selected by the vendor and are typically packaged for display by adhering a gift card to a cardboard backer using removable adhesive and/or by wrapping the gift card to the backer using a clear plastic wrap. The backer typically includes a hole for receiving a display stand peg so that the backer and card may be hung upon a display stand in a retail setting. The card and/or the backer typically include indicia such as a trademark, logo, and card amount.

Gift cards are often associated with or provided by a particular retail vendor and can only be used to make purchases at a store or online ecommerce site associated with that particular vendor. Alternatively, gift cards may be provided by a bank or credit card company and may be used in a similar manner to a credit or debit card to make purchases from various vendors.

Gift cards may comprise a stored value card whereby a certain cash equivalent value is encoded upon a magnetic strip applied to the surface of the card. This stored value may be determined by the vendor prior to packaging and display for sale or may be selected at the point of sale by the purchaser and loaded by the cashier using a magnetic card reader/writer. As an alternative to a magnetic strip, a transaction card may use a bar code to link the card to an account by which the associated value is stored in a computer database.

Gift cards are often presented for sale on display racks in stores, each card or packet of cards being hung upon a display stand peg. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards and gift card packets.

Although they do offer a degree of personalization, in that the gift giver has at least selected a vendor that presumably offers merchandise or services of interest to the recipient, gift cards associated with or provided by a specific vendor are often considered too restrictive by both the gift giver and gift recipient as they limit purchases to that one vendor. Gift cards associated with banks or credit card companies are often considered too impersonal and merely as a more safe and convenient alternative to giving a gift of cash.

What is needed is a gift card holder for displaying and holding multiple gift cards from various vendors in an integrated package that also allows for scanning of each card without detachment from the package.

BRIEF DESCRIPTION OF THE INVENTION

The purpose of this invention is to provide a card holder assembly for holding multiple transaction cards, such as gift cards, to a common backer panel for presentation and sale. The assembly provides certain structures for enabling cards held thereto to be lifted away from the assembly for scanning by a card reader without necessitating removal of the cards. The assembly also provides for bundling and sale of multiple cards associated with multiple different vendors in one unit. An embodiment of the card holder assembly may include a backer panel, foldable tabs for holding transaction cards thereto, and a cover panel for enclosing the cards and bearing a greeting, themed design or message.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
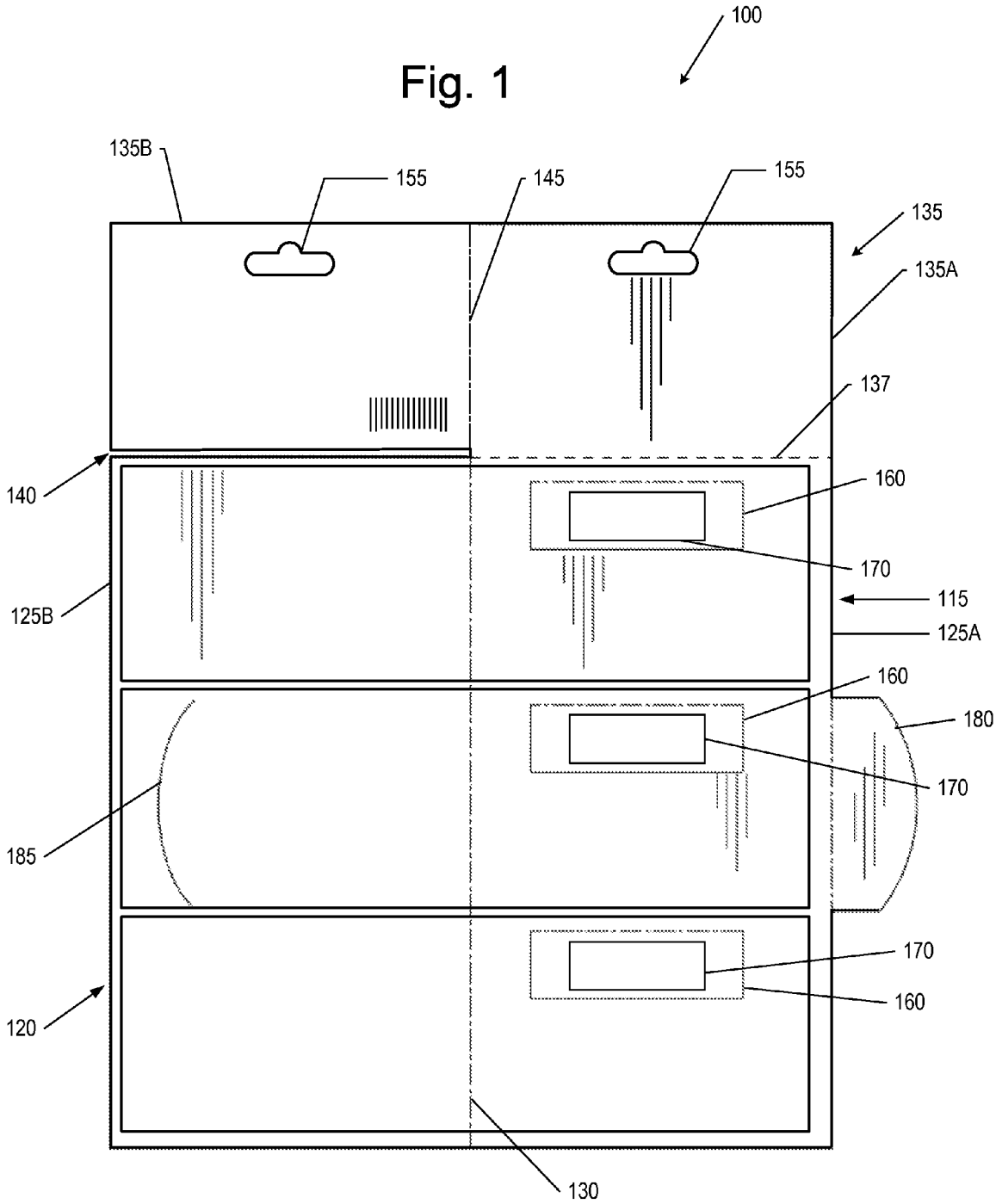
FIG. 1 is an elevation view of first and second sides of an unassembled card holder in an unfolded disposition.
Figure 2:
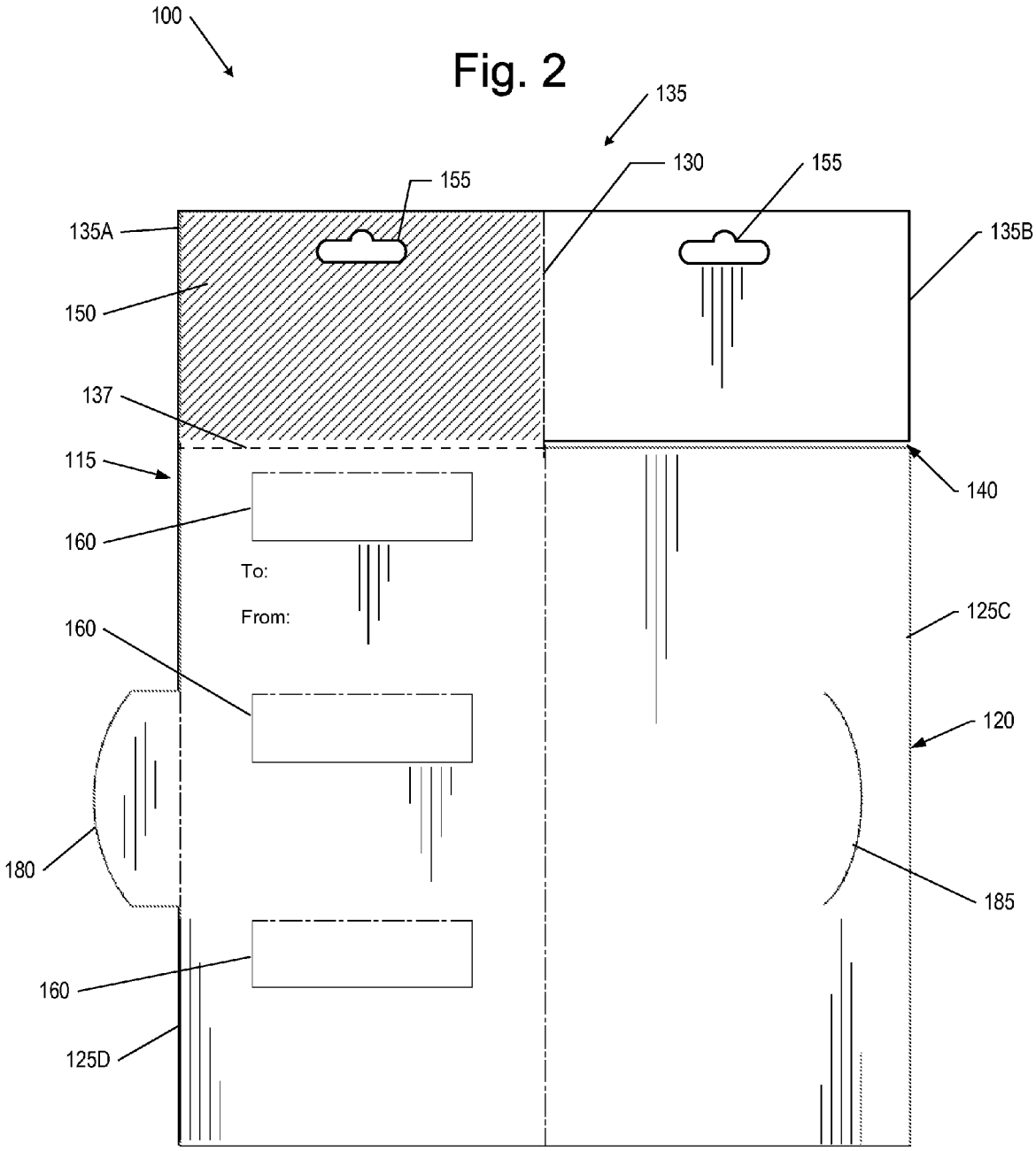
FIG. 2 is an elevation view of third and fourth sides of an unassembled card holder in an unfolded disposition.
Figure 3:
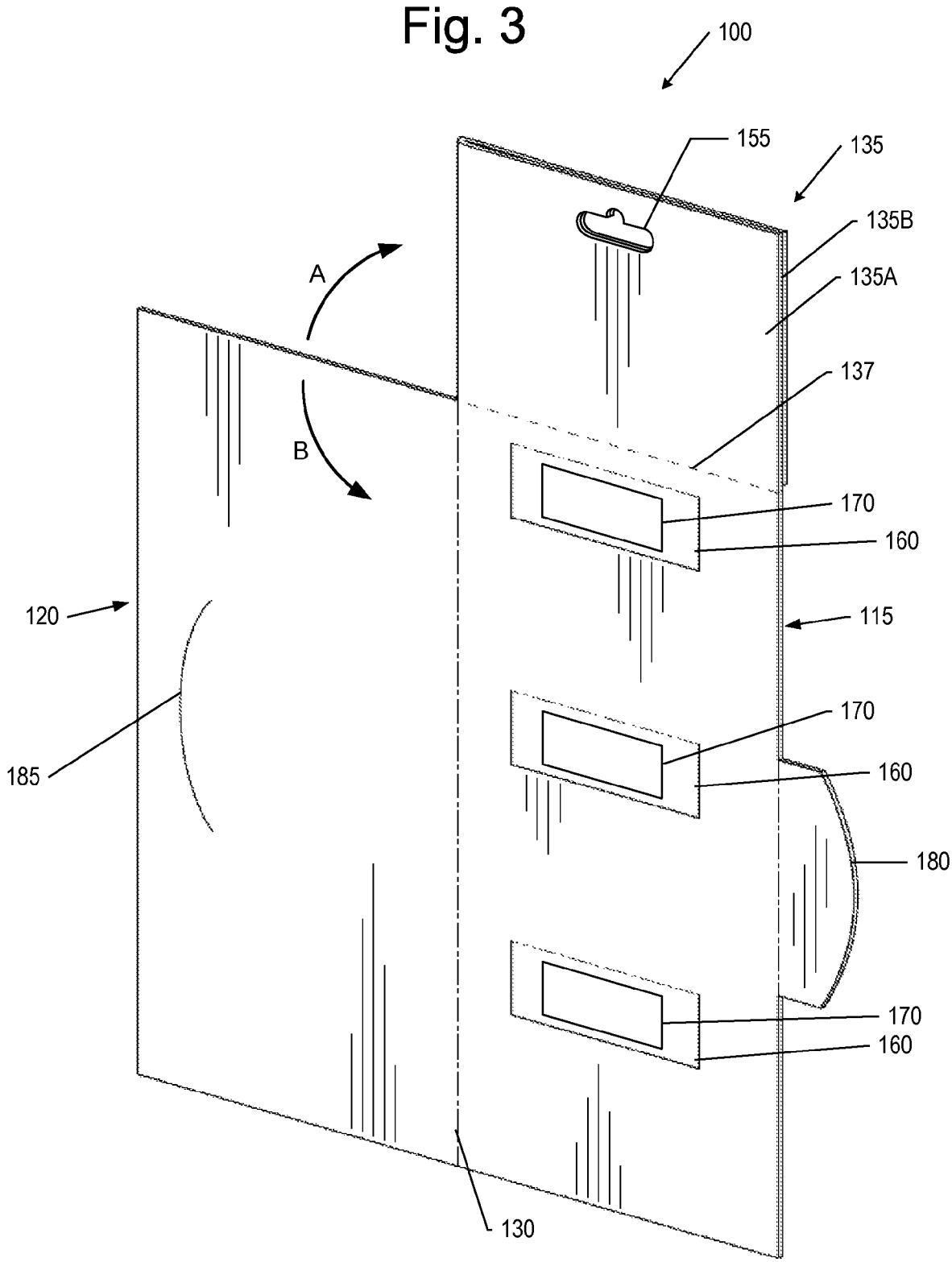
FIG. 3 is a perspective view of a card holder showing header subpanels folded against each other to attach to one and form a header portion.

With reference to the figures, FIGS. 1-10 illustrate one or more embodiments of a transaction card holder 100 for holding multiple transaction cards 105, including transaction cards issued from disparate vendors. The holder 100 includes a first panel or backer panel 115 to which the cards 105 are removably attached and a second panel or cover panel 120 for folding over the backer panel 115 prior to giving the holder 100 to a recipient. The cover panel 120 encloses the cards 105 and may bear a greeting, themed design or message. FIG. 1 is an elevation view of a first 125*a* side and a second side 125*b* of an unassembled card holder 100 in an unfolded disposition. FIG. 2 is an elevation view of a third side 125*c* and a fourth side 125*d* of an unassembled card holder 100 in an unfolded disposition. FIGS. 1 and 2 show the backer panel 115 and cover panel 120 joined to one another along an elongated, longitudinal hinge line 130 shown in broken lines.

The backer panel 115 panel includes an upper header portion 135 that comprises two subpanels 135*a* and 135*b*. Subpanel 135*a* extends from the upper margin of the backer panel 115. Scoring, perforations and/or indicia indicating a cut line 137 may divide subpanel 135*a* from the backer panel 115 along the margin therebetween. Subpanel 135*b* extends from a side margin of subpanel 135*a* to lie above the cover panel 120 when said panels are lying flat in an unfolded and unassembled disposition, as shown in FIGS. 1 and 2. A gap 140 is provided between subpanel 135*b* and the cover panel 120 so that subpanel 135*b* may be folded along fold line 145 (typically partially coextensive with line 130) to overlie and attach to subpanel 135*a*. As shown in FIG. 2, subpanel 135*a* (or subpanel 135*b*) may be provided with adhesive 150 to attach the subpanels to each other when folded inward against each other. As shown in views of the assembled holder 100, the header portion 135 includes a centrally located aperture or peg hole 155 for receiving the peg of a product display stand (not shown).

Figure 5:
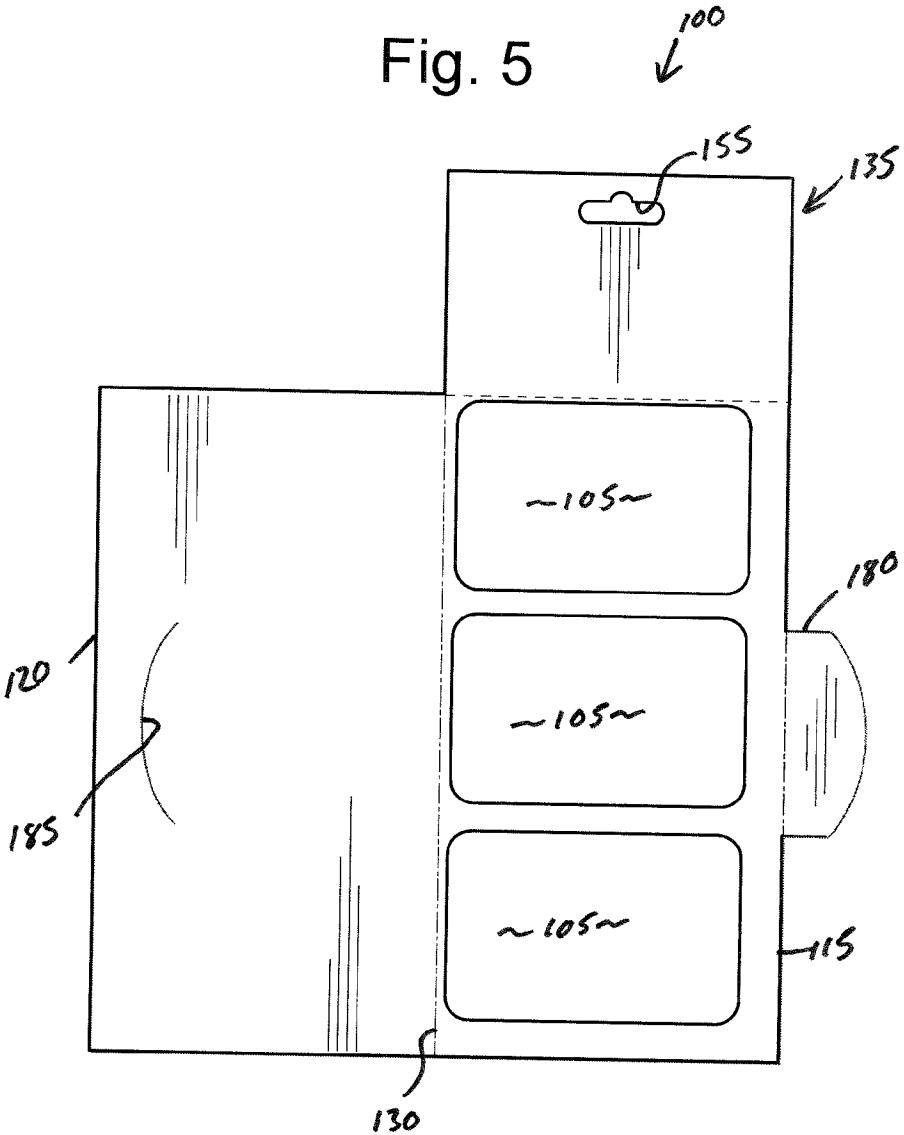
FIG. 5 is an elevation view of an assembled card holder in an unfolded disposition and showing first and second sides thereof.
Figure 4:
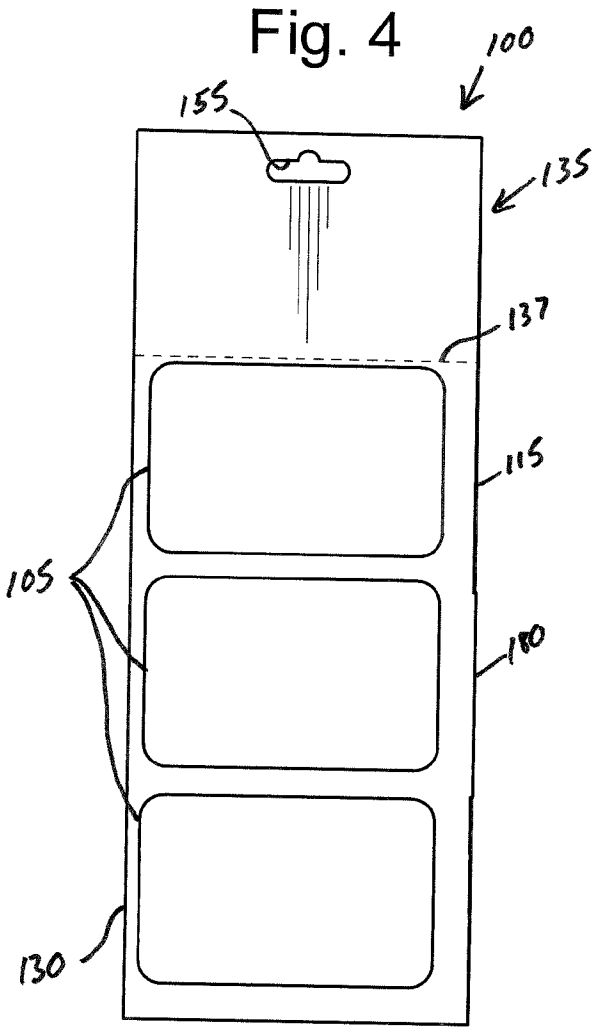
FIG. 4 is a front elevation view of an assembled card holder in first folded disposition for display for sale.
Figure 12:
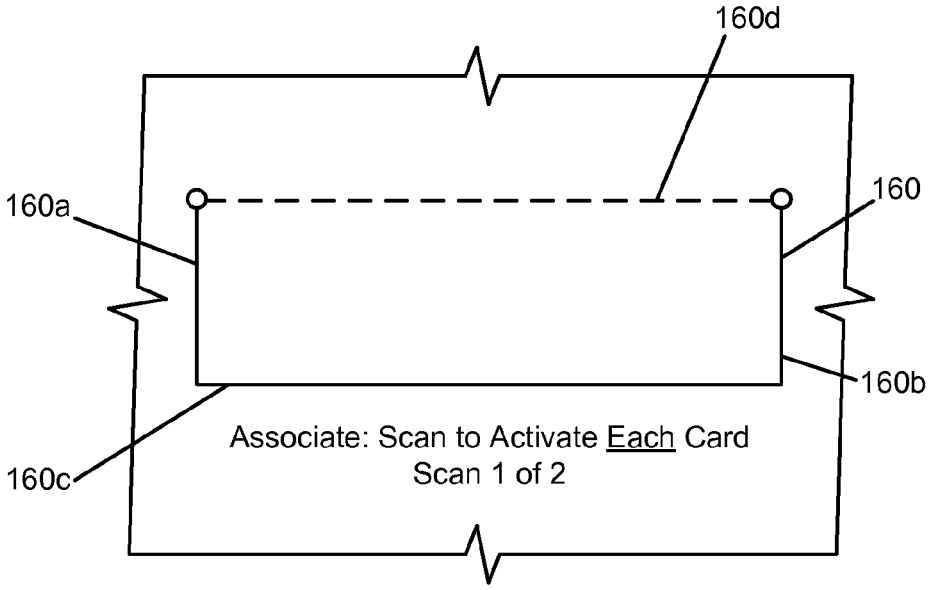
FIG. 12 is partial elevation view of a tab for holding transaction card.
Figure 13:
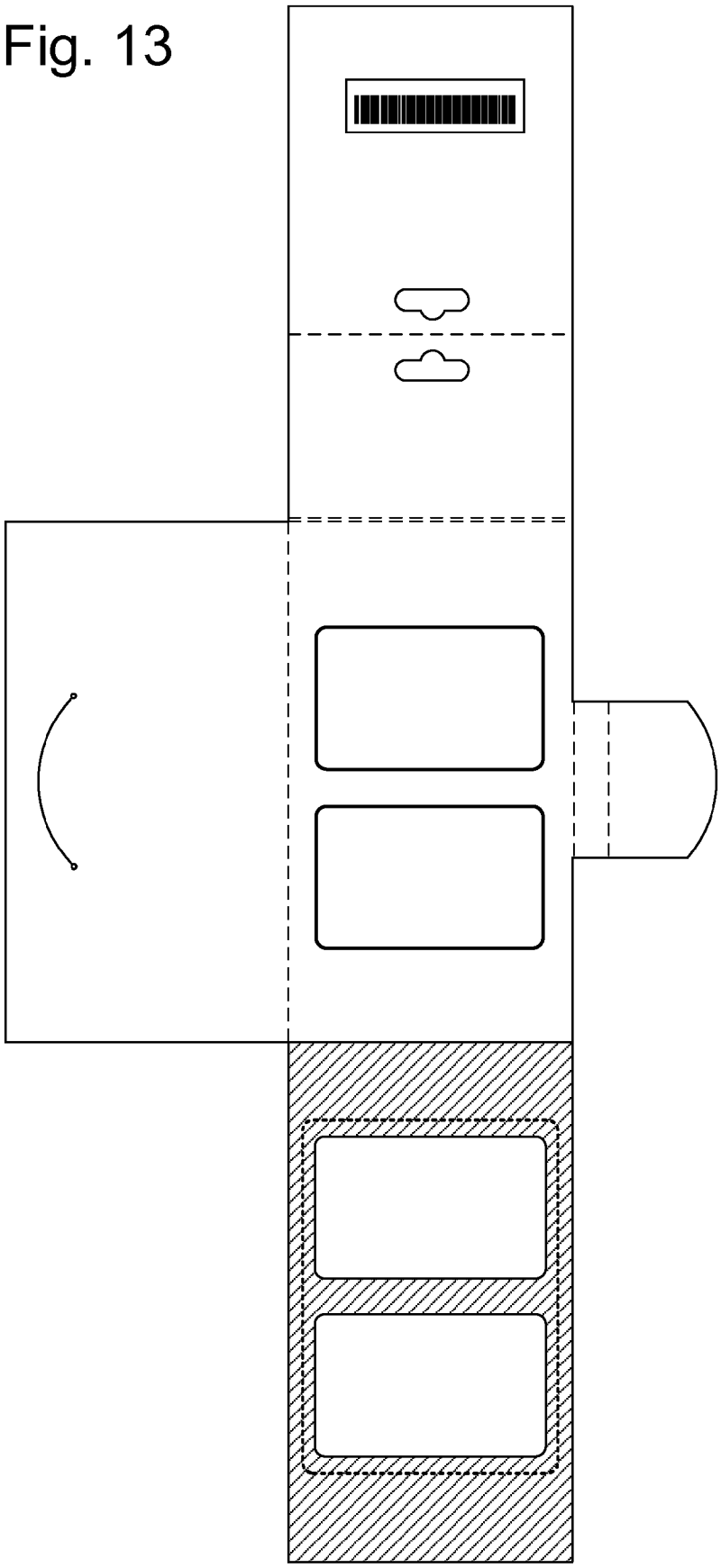
FIG. 13 is an elevation view of first and second sides of an alternative embodiment of a card holder, unassembled and in an unfolded disposition.
Figure 14:
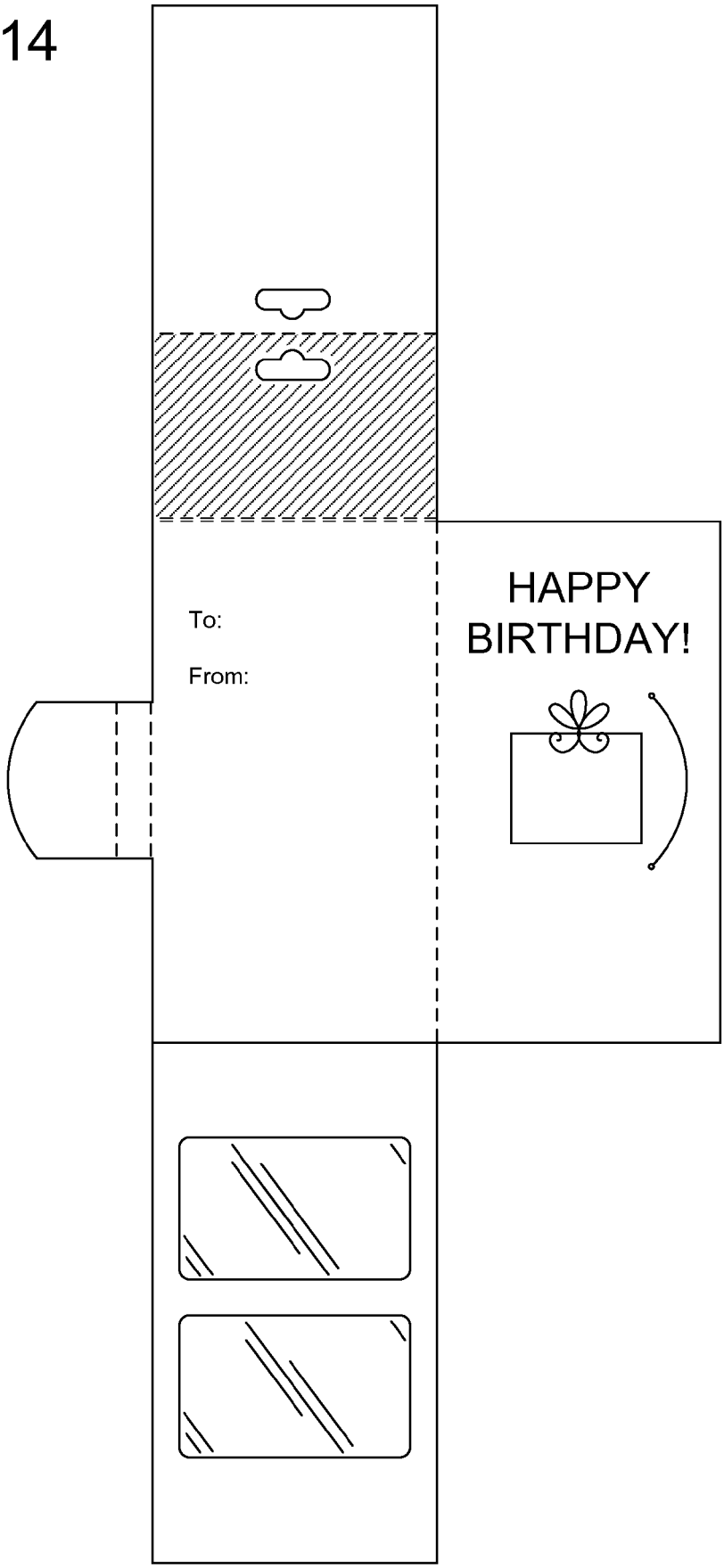
FIG. 14 is an elevation view of third and fourth sides of an alternative embodiment of a card holder, unassembled and in an unfolded disposition.
Figure 15:
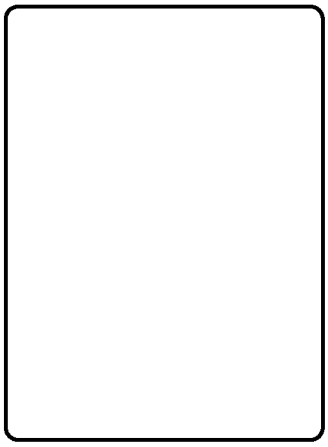
FIG. 15 is a plan view of a clear, cover sheet.
Figure 16:
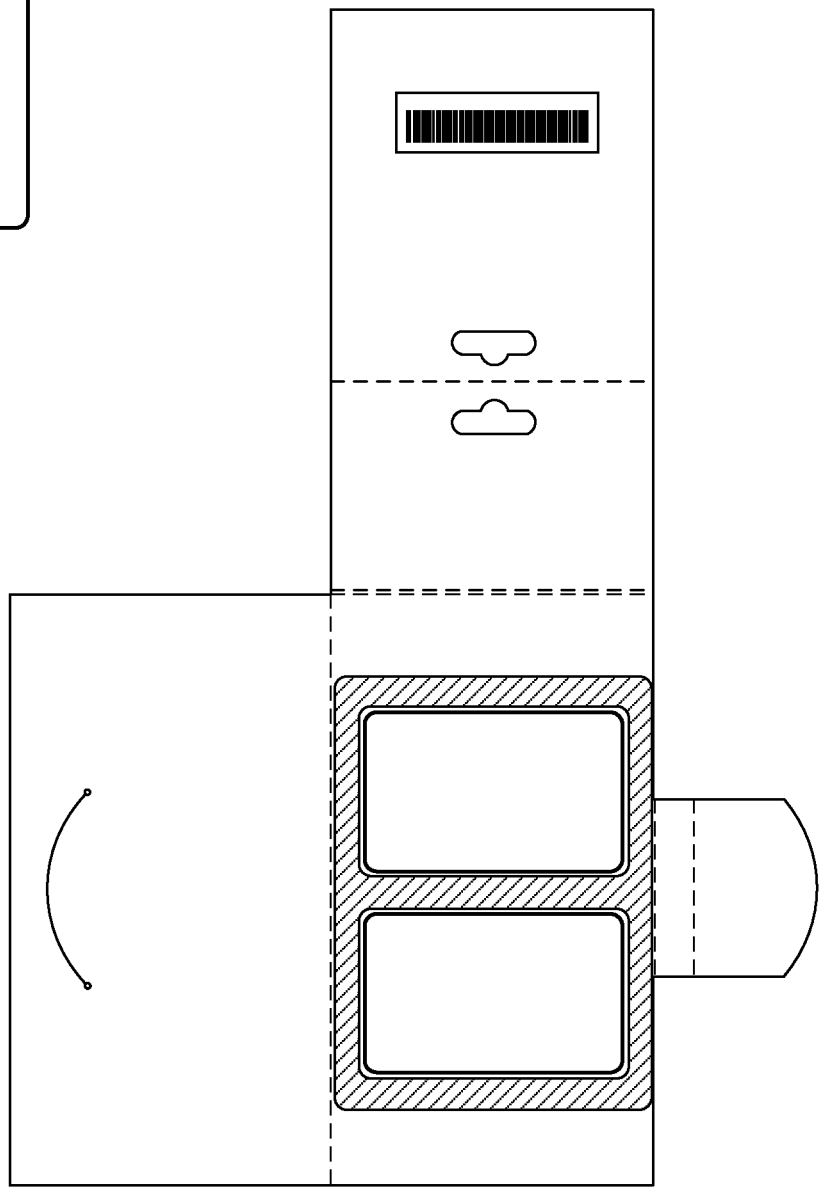
FIG. 16 is an elevation view of first and second sides of a further alternative embodiment of a card holder, unassembled and in an unfolded disposition.
Figure 17:
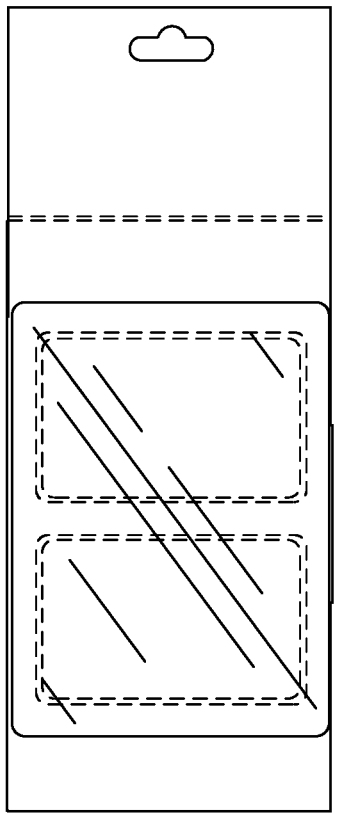
FIG. 17 is a front elevation view of the card holder of FIG. 16 in a first folded disposition for display for sale.
Figure 20:
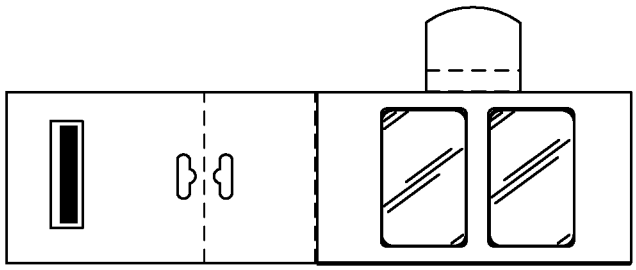
FIG. 20 is an elevation view of the card holder of FIG. 18 showing the cover panel folded backward to lie behind the backer panel.
Figure 19:
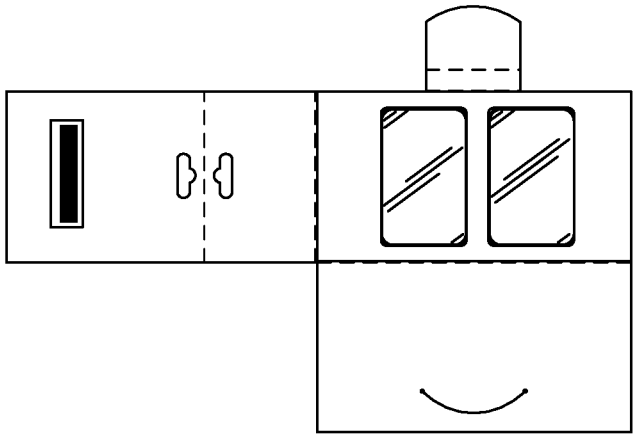
FIG. 19 is an elevation view of the card holder of FIG. 18 showing the cover sheet panel folded forward and upward to adhere to and substantially cover the backer panel.
Figure 18:
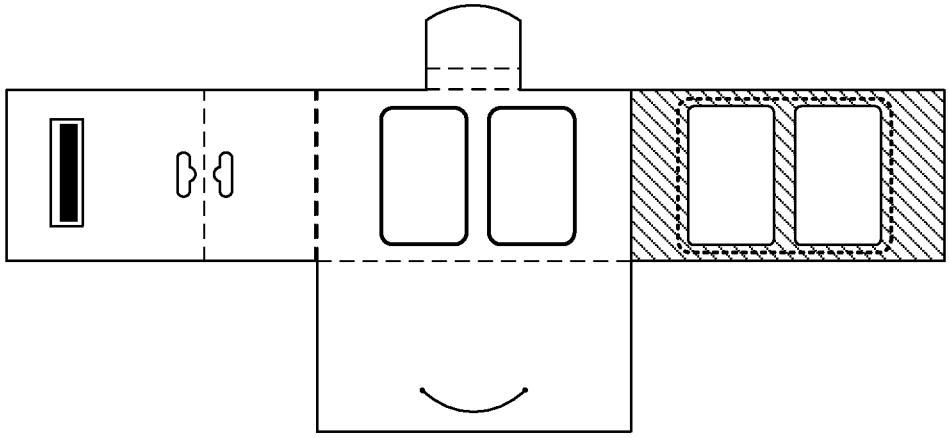
FIG. 18 is an elevation view of a card holder, unassembled and in an unfolded disposition.
Figure 23:
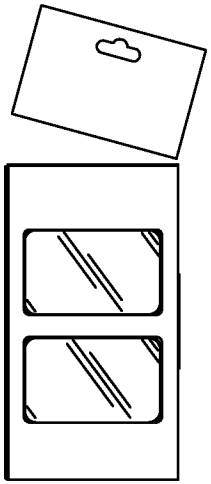
FIG. 23 is an elevation view of the card holder of FIG. 18 showing the header cut or torn away along the header cut line.
Figure 22:
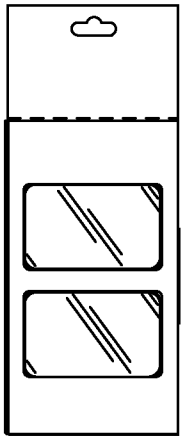
FIG. 22 is an elevation view of the card holder of FIG. 18 showing the distal subpanel of the header folded backward and downward to adhere to the proximate subpanel of the header and form an assembled card holder prepared for display at a point of sale.
Figure 21:
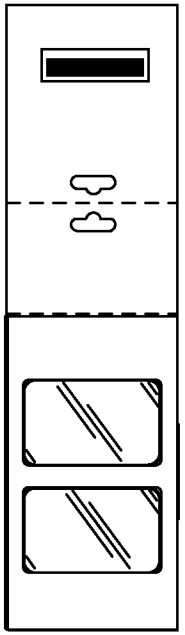
FIG. 21 is an elevation view of the card holder of FIG. 18 showing the flap folded backward to engage the slit in the cover panel.

The front side 125*a* of the backer panel (first side of the holder) includes several (in the present example, three) backer panel tabs 160 to accommodate attachment of three transaction cards 105, one card 105 to each tab 160. Each tab 160 is cut on three contiguous sides 160*a*, 160*b* and 160*c* (see FIG. 12) from the material of the backer panel 115 to form a structure that may either lie in the plane of the backer panel 115 or be folded away from the plane of the backer panel 115 by rotating or bending the tab 160 upward about folding line 160*d*, see FIG. 10. Removable adhesive 170 is applied to the front surface of each of the tabs 160 to adhere a card 105 to each tab 160. The position or location of transaction cards 105 upon the tabs 160 and backer panel 115 is shown in FIGS. 4 and 5. A message alerting a store clerk or cashier to scan each transaction card 105 on the holder 100 may be provided proximate to a tab 160 as shown in FIG. 12.

Figure 10:
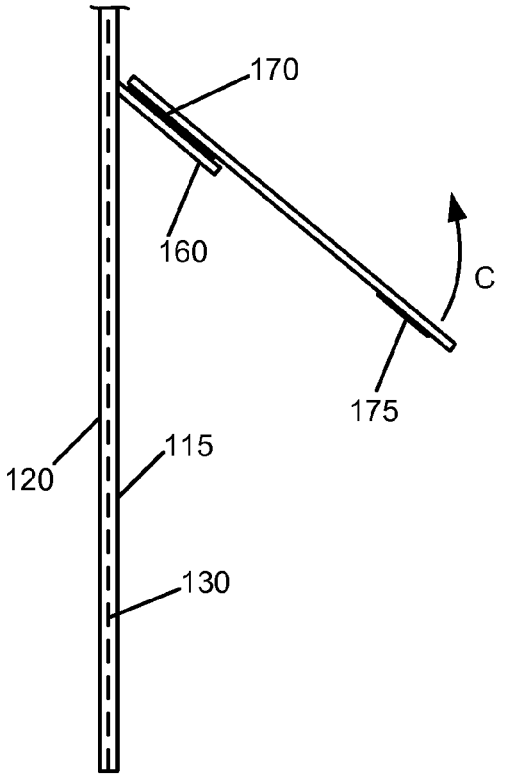
FIG. 10 is a partial, side, diagram view showing a transaction card lifted away from the backer panel in order to reveal a magnetic strip on the rear surface of the card for scanning.
Figure 11:
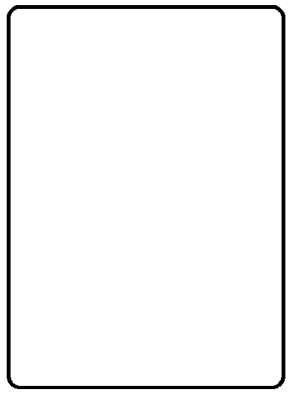
FIG. 11 is a plan view of a clear, cover sheet.

FIG. 10 is a partial, side, diagram view showing a transaction card 105 lifted away from the backer panel 115 in the direction of arrow C to reveal a magnetic strip 175 on the rear surface of the card 105 for scanning. In this manner, each individual card 105 attached to a holder 100 may be individually scanned and activated and/or loaded at the point of purchase without removing any of the cards 105 from the holder 100.

Figure 7:
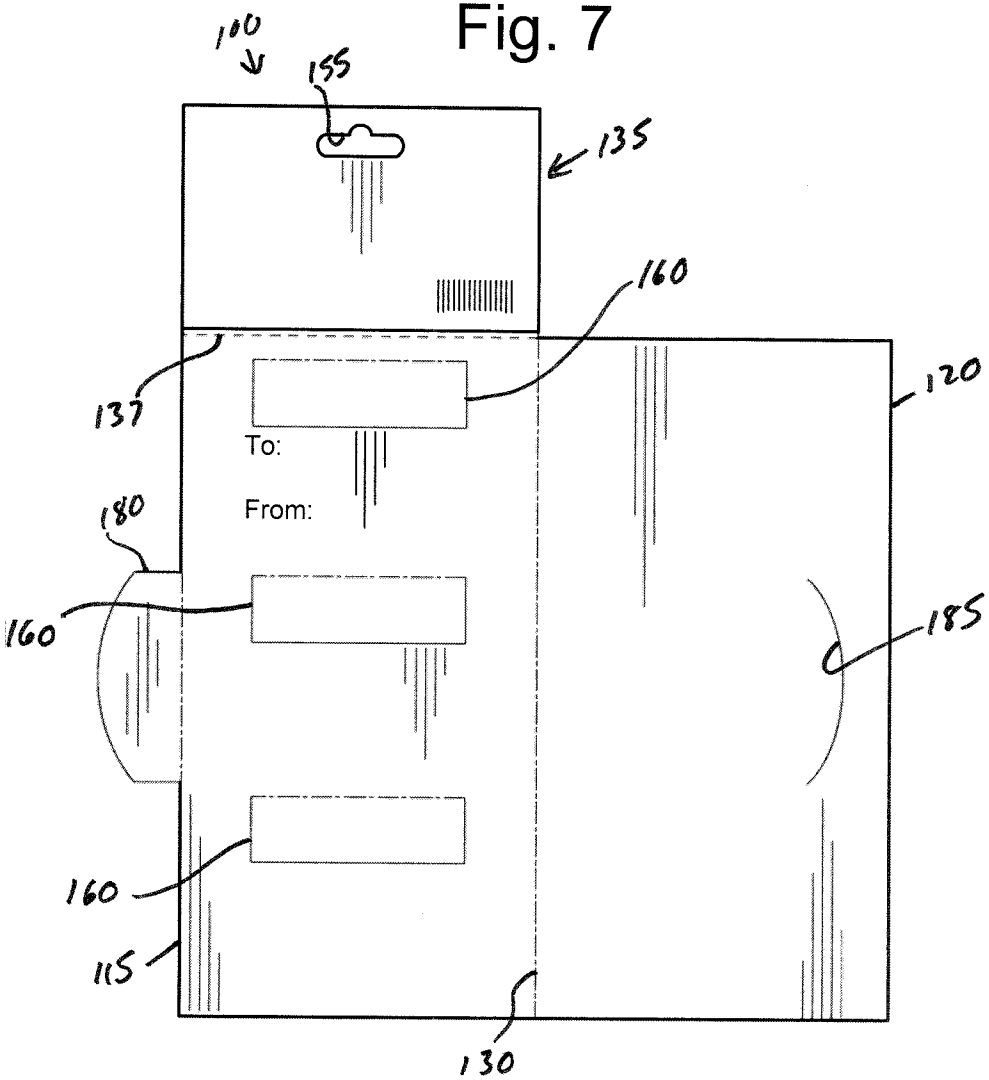
FIG. 7 is an elevation view of an assembled card holder in an unfolded disposition and showing third and fourth sides thereof.
Figure 6:
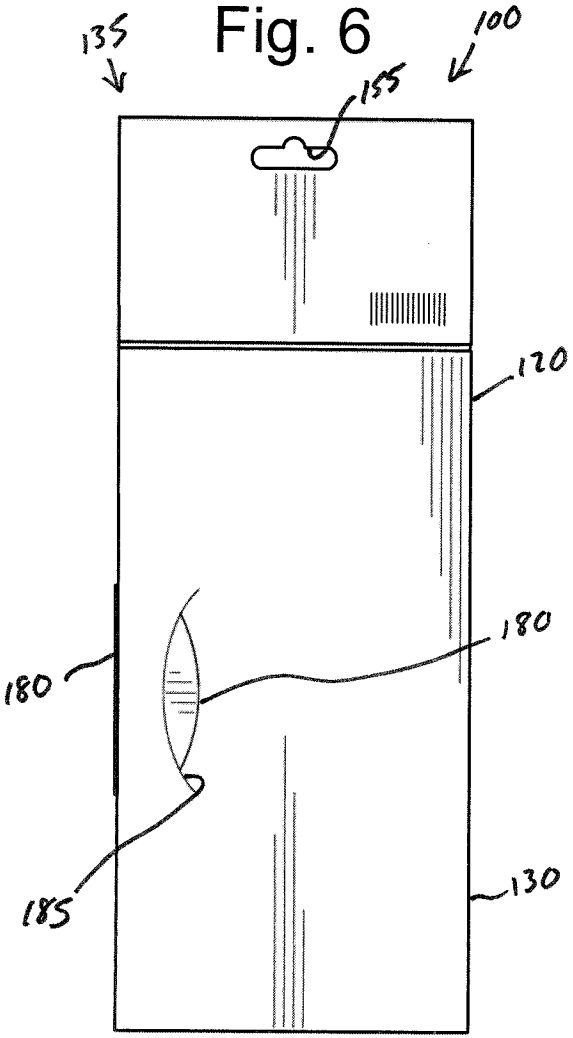
FIG. 6 is a rear elevation view of an assembled card holder in a first folded disposition for display for sale.

When assembled for sale, the holder 100 is typically configured as shown in FIGS. 4 and 6, in a first folded disposition, with the cover panel 120 folded behind the backer panel 115 so that the cards 105 are visible to the purchaser. FIGS. 5 and 7 show the cover panel 120 folded forward to lie in the plane of the backer panel 115.

A flap 180 projects from the margin of the backer panel 115 distal to fold line 130. The flap 180 is sized to insert or slide into an aligned slit 185 in the cover panel 120 in order to retain the cover panel 120 in a closed position folded against the backer panel 115.

Figure 8:
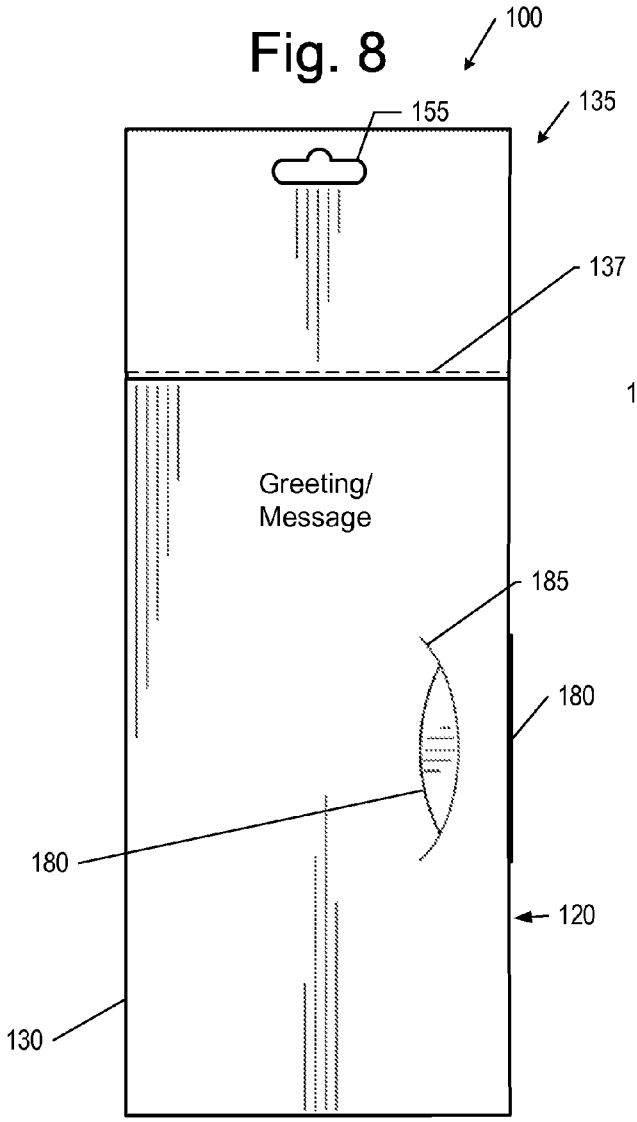
FIG. 8 is a front elevation view of a card holder in a second folded disposition.
Figure 9:
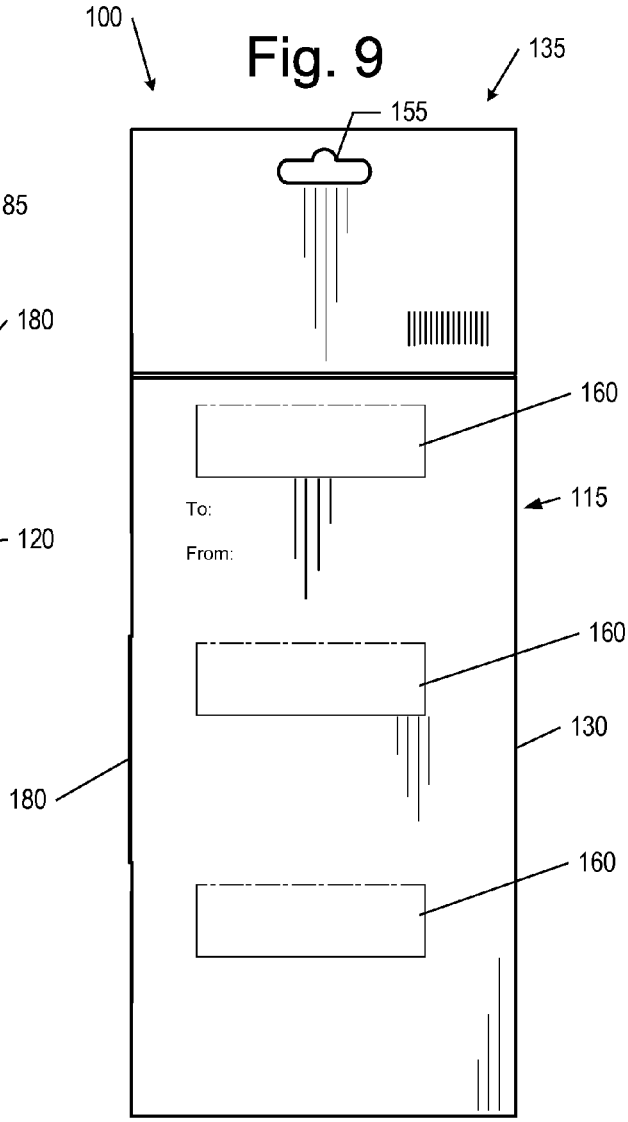
FIG. 9 is a rear elevation view of a card holder in a second folded disposition.

FIG. 8 is a front elevation view of a card holder 100 in a second folded disposition for presentation to a gift recipient. The holder 100 is placed in this second folded disposition by rotating the cover panel 120 from its first folded disposition lying behind the backer panel 115 (see FIGS. 4 and 6) to a second folded disposition lying over the backer panel 115 and with the flap 180 engaged with the slit 185 (see FIGS. 8 and 9). Prior to giving the holder 100 and enclosed cards 105 to a gift recipient, the holder 100 is placed in the second folded disposition, as described above, and the header portion is removed from the backer panel 115 by cutting, tearing or otherwise detaching along line 137, thereby resulting in the remaining portion of the holder 105 forming an envelope structure for conveying the cards 105. Messages, greetings, instructions, designs, graphics and/or "To/From" indicia may be included on the surface of the holder 100.

It should be appreciated that the holder 100 and its associated structures may be constructed in various shapes and forms and bearing various graphics and designs while maintaining the general structure and functionality described herein.

Having thus described the invention, what is claimed as new and desired to be secured by Letters Patent is:

1. A transaction card holder comprising:

a first panel hingedly connected to a second panel along a fold line, said second panel sized to substantially cover said first panel when folded along said fold line, a separable header portion extending from the upper margin of said first panel, said first panel including a plurality of tabs, said tabs comprising three free sides and a fourth side pivotally attached to said first panel, said tabs each including means for removably attaching a transaction card thereto, said second panel folded behind said first panel in a first folded position so that said cards remain visible upon said first panel, and said second panel folded over said first panel in a second folded position so that said cards are covered by said second panel.

2. The card holder of claim 1, wherein a line of perforations divides said header portion from said first panel.

3. The card holder of claim 1, wherein said header portion comprises a first subpanel extending from the upper margin of said first panel and a second subpanel extending from a side margin of said first subpanel, said second subpanel folded upon said first subpanel and attached thereto to form said header portion.

4. The card holder of claim 1, wherein indicia indicating a cut line divides said header portion from said first panel.

5. The card holder of claim 1, wherein said header portion includes an aperture sized to receive a display stand peg for hanging said holder thereupon.

6. The card holder of claim 1, wherein each of said tabs is cut on three contiguous sides from the material comprising said first panel, leaving one side of each tab contiguous with said first panel and defined by a fold line.

7. The card holder of claim 1, wherein said cards are positioned upon said tabs to leave card magnetic strips uncovered by said tabs.

8. The card holder of claim 1, wherein said cards are attached to said tab using removable adhesive.

9. The card holder of claim 1, wherein each of said cards bears distinguishing indicia.

10. The card holder of claim 1, wherein each of said cards are associated with a different vendor.

* * * * *